United States Patent [19]

Paule et al.

[11] 3,941,379

[45] Mar. 2, 1976

[54] PIN ROPE CONTROL

[76] Inventors: Helmut Paul Paule, King Side Road, King City; Oskar Leonard Kinzler, Blue Star Acres, South Road, Oak Ridges, both of Canada

[22] Filed: Sept. 9, 1974

[21] Appl. No.: 504,421

[30] Foreign Application Priority Data

Sept. 19, 1973 Canada ..... 181448

[52] U.S. Cl. ..... 273/44; 250/222 R

[51] Int. Cl.[2] ..... A63D 5/08

[58] Field of Search..... 273/44; 250/222 R, 224; 324/34 D, 34 PS, 34 RS

[56] References Cited

UNITED STATES PATENTS

| | | | |
|---|---|---|---|
| 3,319,070 | 5/1967 | Schneider | 250/222 R |
| 3,458,191 | 7/1969 | Murdoch et al. | 273/44 |
| 3,829,089 | 8/1974 | Butterfield | 273/44 |

FOREIGN PATENTS OR APPLICATIONS

| | | | |
|---|---|---|---|
| 844,454 | 6/1970 | Canada | 273/44 |

*Primary Examiner*—Anton O. Oechsle

[57] ABSTRACT

A pin rope control device, in which the pulley provided for the rope is completely free to rotate at all times without any mechanical engagement of the pulley at any time. Remote movement sensing devices are provided along side the pulley, which detect movement of the pulley and deliver a predetermined sequence of signals. Suitable circuitry is provided to receive the sequence of signals, and to activate the rope tensioning motor to reset the pins. In one embodiment, a magnet is mounted to rotate in unison with the pulley and actuate in sequence a pair of stationarily mounted reed switches to trigger operation of the motor. In a second embodiment, the sensing device is in the form of a photocell.

13 Claims, 6 Drawing Figures

PIN ROPE CONTROL

The invention relates to a control device for controlling the ropes of bowling pins.

BACKGROUND OF THE INVENTION

The setting of bowling pins by means of ropes offers many advantages over other systems. However, in the past bowling alleys employing pin ropes were found to be less popular with the public. This was due to the fact that the rope did not permit the pins to fall as easily as they would fall if there were no ropes. As a result, scores on pin rope alleys were somewhat lower then on other bowling alleys. Most pin rope setting control devices as have been employed in the past, have employed a rope running over a pulley. At some time during the cycle of the apparatus the pulley was interengaged with some form of control. Either it was simply checked entirely, or alternatively it was engaged with some form of mechanical clutch system. In either case, the pulleys were never entirely free to run at the most critical time i.e. when the bowling pin was falling. At this time, it was always necessary in the past for the rope either to slide around the pulley, thereby creating a certain amount of friction, or it was necessary for the rope to turn the pulley against some degree of friction imposed by some mechanical linkage or clutch means. In some cases, the bowling pins would not fall in the correct pattern, thereby affecting the score of the bowler, and in other cases the pin might simply remain standing when, but for the drag on the rope, it would have fallen.

In addition to these disadvantages, the fact that there was friction either between the rope and the pulley, or between some parts of the pulley mechanism or clutch mechanism meant that every time the pins fell there was a certain degree of wear, and in fact this built up quite rapidly, and once the parts became worn the friction force increased and so the wear increased. As a result, these types of systems required quite a substantial amount of maintenance involving down time of the bowling alleys and costly delays while the parts were repaired.

In all such pin setting machines the pin ropes are tensioned by a common rope tensioning mechanism which operates all five pin ropes simultaneously, in the case of five pin bowling for example. A separate pin rope setting control device is provided for each rope, and it is required that the control device shall react to the falling of its respective pin so as to procure one cycle of operation of the common tensioning apparatus. The pin rope control device also incorporates a brake which then jams against the rope of the pin that has fallen and holds it up in an inoperative position, while permitting the remaining pins to be set once more. After all pins have fallen the tensioning device will then reset all five pins simultaneously. In order to perform satisfactorily it is essential that each of the five control devices for the five pin ropes shall react only when the pin has fallen, and not when it is merely brushed against so that it rocks but does not fall.

In order to achieve this degree of sensitivity in the prior art devices, some form of means for stopping the rope pulley at a predetermined point was provided.

A somewhat improved form of control device is shown in Canadian Pat. No. 844,454. In this device, the movement of the rope pulley is detected by means of a reed switch mounted along side the pulley, and a pair of magnets in the pulley activate the reed switch.

In order to preset the wheel, and its associated magnets, in a predetermined position each time the pin is reset, a wheel locking device is provided which automatically locks the wheel just prior to the pin descending in the resetting cycle. Thus, during resetting it is necessary for the pin to drag the rope around the pulley, until the pin reaches the floor. At this point, the wheel locking device is then deactivated leaving the the pulley free to rotate when the pin falls. This device, however, is unsatisfactory in that the repeated slippage of the rope over the pulley when it is held stationary during the resetting cycle eventually causes wear on the pulley, and these must then be replaced with consequent additional expense. Furthermore, this device requires the use of two electrical solenoids, one to operate the brake for the rope and the other to operate the stop device for the pulley thereby doubling the likelihood of breakdown, and consequent further delays and expense.

BRIEF SUMMARY OF THE INVENTION

The invention therefore seeks to provide a pin rope control device, in which the pulley provided for the rope is completely free to rotate at all times without any mechanical engagement of the pulley at any time. Remote movement sensing means are provided along side the pulley, which detect movement of the pulley and deliver a predetermined sequence of signals. Suitable circuit means are provided to receive the sequence of signals, and to activate the rope tensioning means to reset the pins.

Preferably, the remote sensing means will be in the form of two or more reed switches mounted along side the pulley, and a single magnet is mounted in the pulley. However, the invention envisions the use of other forms of remote sensing such as photo-sensitive means, proximity switches and the like, the term remote sensing means being used to include any such means for generating a signal responsive to the movement of the pulley, without mechanical contact with the pulley.

According to the invention two such reed switches, or other remote sensing means, are provided, and activation of both such reed switches is required before the rope tensioning means is activated. In one form of the invention a series of holding coils are provided, one for each reed switch so that as each switch is activated it is then held closed by its respective holding coil, and when all such switches have been activated the circuit is complete, thereby delivering a signal to the rope tensioning means.

In another form of the invention a counter is provided for each pulley wheel, and it will deliver a signal to the rope tensioning means upon receipt of signals from both reed switches. Clearly, if there are more than two reed switches on the pulley then the counter will deliver the rope tensioning signals upon receipt of the appropriate number of reed switch signals.

Preferably, timer means are incorporated in the circuit to introduce a predetermined delay between the detection of movement of a pulley, and the actual operation of the rope tensioning means. This then allows sufficient time for the pin to fall freely before it is drawn upwardly once more.

The foregoing and other objectives of the invention will become apparent from the following description of a preferred embodiment of the invention which is given here by way of example only with reference to the following drawings.

DESCRIPTION OF A PREFERRED EMBODIMENT

Figure 1:
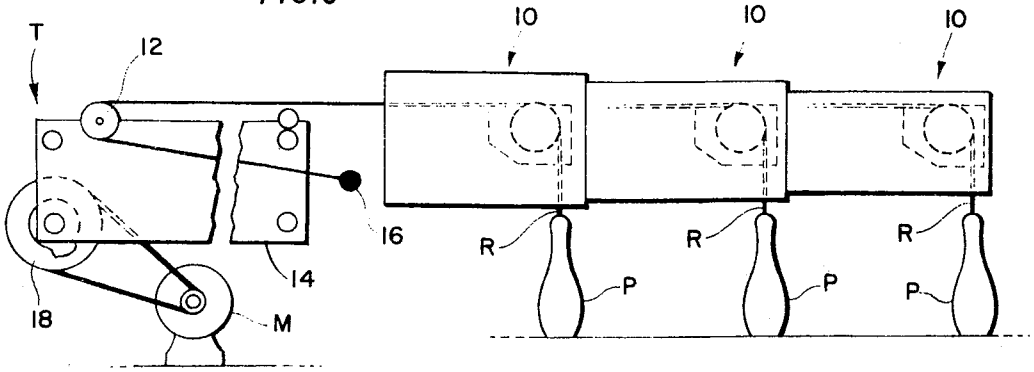
FIG. 1 is a schematic side elevational view of a bowling alley installation.

Referring to FIG. 1, it will be seen that this shows in schematic form the arrangement of a typical five pin bowling pin setting apparatus. The bowling pins P are shown suspended on ropes R, by means of which they are reset. The ropes R run upwardly through the pin rope control units according to the invention shown as 10, and from there they run rearwardly to the rope tensioning mechanism shown generally as T. It will be appreciated that the rope tensioning mechanism T is essentially conventional, and well known in the art, being controlled by the rope tensioning control units 10 in a manner to be described below. The rope tensioning unit T will consist of a common transverse tensioning bar 12 mounted on an endless drive chain 14 running around a predetermined track. The track is here shown as being rectangular although in fact in practice such a track will have a somewhat different path, the details of which are omitted for the sake of clarity.

Two such chains 14 are provided on opposite sides of the apparatus, supporting the two ends of the bar 12, only one such chain 14 being shown.

The free end of the rope R is fastened as at 16. By means of a motor M and a reduction gear drive 18 the chain 14 may be driven in an anti-clockwise direction around the track of the chain 14, and such movement will tension all five ropes R for all five pins P. As the tensioning bar 12 reaches the limit of its forward travel i.e. on the extreme right hand of the track of the chain 14, it will come to a halt. The five ropes R will then be found to be laying in separate elongated loops, and are therefore completely free to run in response to the falling of a pin without any obstruction to their movement.

As stated, all of these basic functions are well known in the art and are common to the majority of pin rope setting machines that are presently available.

Each time a pin or pins is knocked down, the entire rope tensioning apparatus T goes through the cycle for tensioning all five ropes R. However, since two or three of the pins may be left standing, their associated ropes are already lying in loops where they have already been deposited by the movement of the tensioning bar 12, and accordingly such pins as are already standing are simply raised upwardly, and then deposited down in the same position once more. However, the pins that have already fallen must be removed temporarily, and accordingly these pins are withdrawn upwardly, and are then held there while the remaining two or three pins are reset. At the completion of the bowler's turn, then all five pins must again be reset ready for the next turn.

In order to provide for these two separate functions, the pin rope control units 10 according to the invention are provided, together with associated control means as shown in FIGS. 2 to 5.

Figure 2:
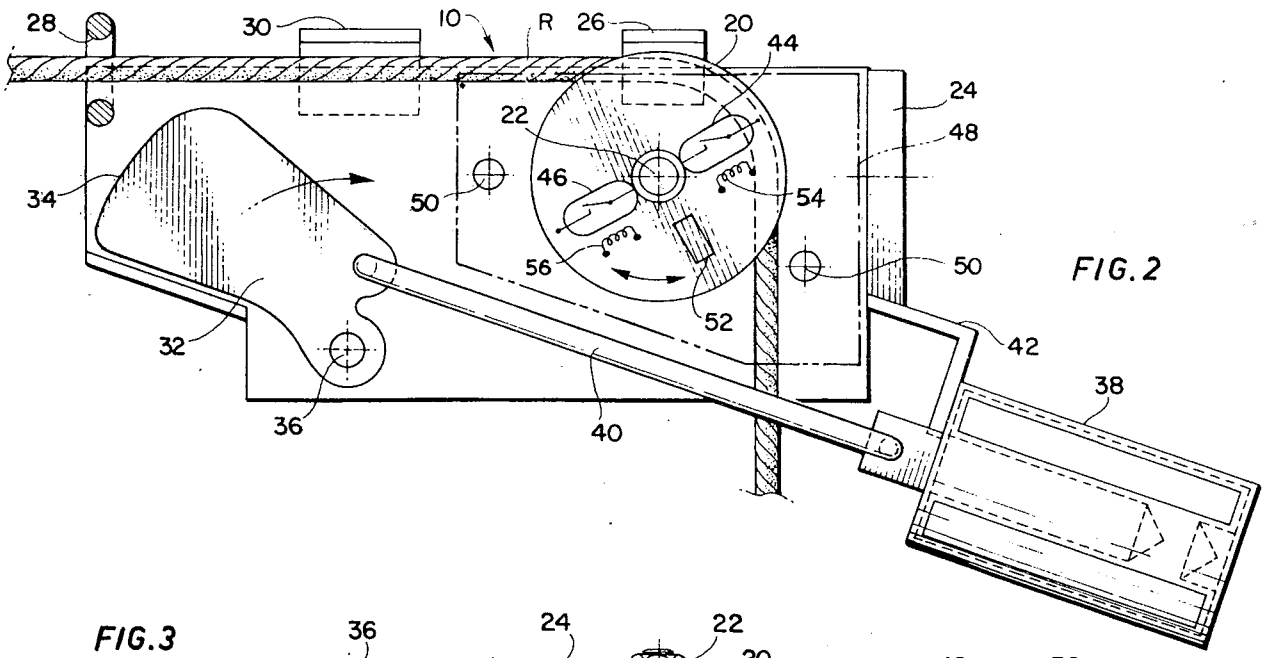
FIG. 2 is a side elevational view, partially cut away of the rope control device according to the invention.
Figure 3:
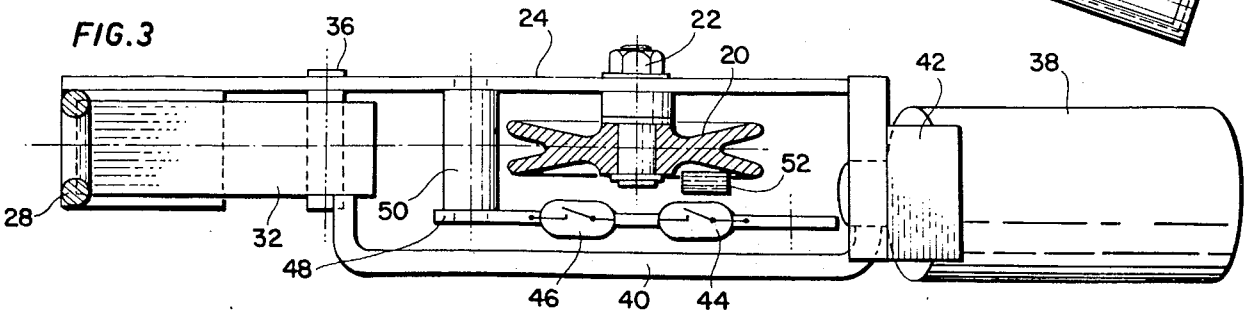
FIG. 3 is a partial top plan view of the rope control of FIG. 2.

Referring now to FIGS. 2 and 3, it will be seen that the pin rope control unit 10, according to the invention, comprises a pulley 20 freely rotatably mounted on a spindle 22, the spindle 22 being bolted or otherwise fastened to a back plate 24. A rope guide 26 fastened to the back plate guides the rope around the pulley, and a further rope guide 28 also mounted on the back plate 24 provides further guidance for the rope.

In order to check the rope when the pin is in its upper most position, and to cause the pin to be suspended in that position, a braking means is provided for gripping the rope which comprises the upper brake shoe 30 attached to the back plate 24 in a fixed position immediately alongside the rope passing between the pulley 20 and the rope guide 28. A lower movable brake shoe 32 is provided having a camming surface 34, and pivoted about a pivot pin 36 for swinging between a lower position as shown, and an upper more or less vertical position in which it jams the rope R against the upper brake shoe 30. The lower brake shoe 32 is operated by means of the electrical solenoid 38, and the operating link 40. Thus, operation of the solenoid 38 in one direction will swing the brake shoe 30 upwardly, jamming the rope between the camming surface 34 and the upper brake shoe 30. The shape of the camming surface 34 is such that the weight of the pin tends to cause increasing jamming pressure on the rope. Thus, even though the solenoid 38 is de-energized, the weight of the pin will still maintain the brake 32 in its operative position. The pin is not in fact released until the rope is drawn rearwardly by the rope tensioning means T, and such rearward movement produces a slight swinging movement of the brake shoe 32 thereby releasing it from the rope and permitting it to swing freely into its lower position.

Brake solenoid 38 is attached to the backing plate 24 by means of the mounting bracket 42.

When a pin P is struck during the course of the game, it will draw the rope R with it, thereby causing the pulley 20 to rotate in a direction which is clockwise in FIG. 2. In order to detect such movement, without any contact with the pulley 20, a pair of reed switches 44 and 46 are mounted on a support plate 48, the support plate 48 being fastened to the backing plate 24 by means of bolts 50. Plate 48 is spaced closely adjacent to the side of pulley 20, the reed switches 44 and 46 being arranged on opposite sides of the centre of rotation of the pulley 20 as shown.

A permanent magnet 52 is mounted on the pulley 20, and is located so that on rotation of the pulley 20 the permanent magnet 52 moves into registration successively with reed switches 44 and 46 or vice versa. In this way, as the pulley 20 rotates the magnet 52 will successively operate the two reed switches in sequence causing them to close.

In order to prevent the reed switches 44 and 46 from reopening up once they have been closed by the magnet 52, holding coils 54 and 56 are provided, connected to a suitable source of power. The strength of the magnetic field created by the coils 54 and 56 is, by itself, insufficient to close their respective reed switches 44 and 46. However, once the magnet 52 has closed the reed switches 44 and 46, the field strength of the coils 54 and 56 is then sufficient to maintain them closed.

Figure 4:
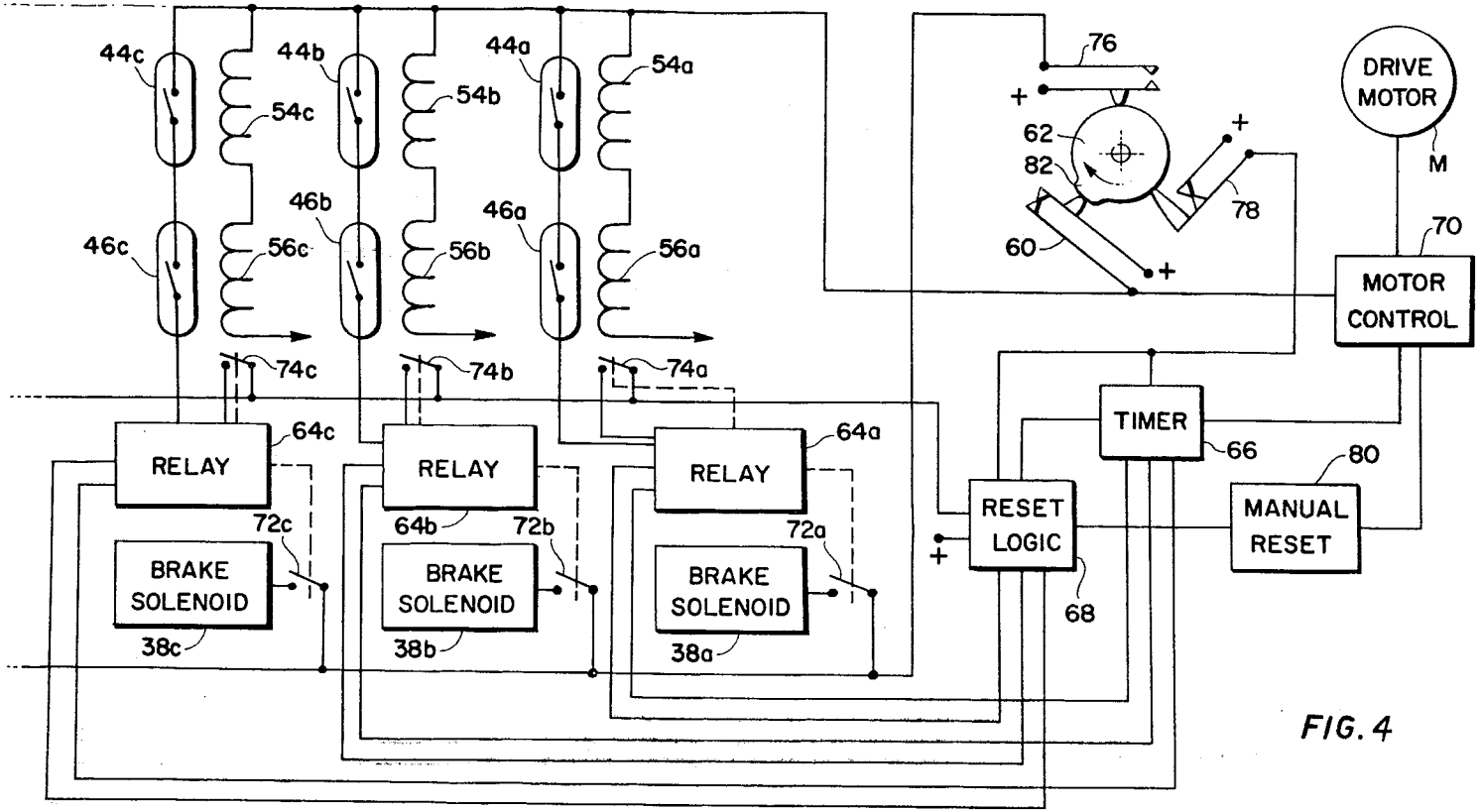
FIG. 4 is a schematic circuit diagramme of a pin setting control installation.

The control circuits, responsive to the signals from the reed switches 44 and 46 are shown in FIG. 4.

In FIG. 4, the reed switches are shown as 44*a*, 44*b*, 44*c* and so on, indicating the reed switches, and holding coils, of respective pulleys 20. Only three such reed switches and associated coils are shown in FIG. 4. However, it will be appreciated that the number of such pairs of reed switches and coils will correspond to the number of pulleys 20, and the number of pulleys 20 will correspond to the number of bowling pins. As is shown in FIG. 4, the reed switches 44 and 46 are connected with one another in series. Similarly, the holding coils 54 and 56 are also connected with one another in series. The reed switches 44 and coils 54 are connected to a source of power through the normally open contact breaker 60, operated by means of the cam control member 62. The cam control member 62 is operated by any suitable drive means connected with the drive motor M, and the reduction gear 18 (see FIG. 1). The cam control 62 makes one revolution for each complete cycle of movement of the tensioning apparatus T. The other contact of the coils 56 is connected to ground. The other contact of the reed switches 46 is connected to a relay 64, the relay 64 being shown as *a*, *b*, and *c* corresponding to respective sets of reed switches *a*, *b*, and *c*.

Each of the relays 64 is connected to the timer 66, and also to the reset logic circuit 68. The timer 66 is also connected with the reset logic 68, and is connected to the motor control 70 which is in turn connected to the drive motor M.

The relays 64 are arranged to operate two switches namely the brake solenoid switch 72, and a relay holding switch 74, the function of which is to hold the relays 64 closed, once they have been operated by their respective reed switches 44 and 46. The relay holding switches 74*a*, *b*, and *c*, are in turn connected to the reset logic 68, which supplies the power to hold the relays 64*a*, *b*, and *c* closed, when the relay holding switches 74*a*, *b* and *c* are themselves closed.

The brake solenoid switches 72*a*, *b*, and *c* are connected to the normally open brake solenoid contacts 76, operated by the cam control 62.

The reset logic circuit 68, together with the timer 66, is connected to the normally closed reset contacts 78 operated by the cam control 62. A manual reset button 80 is provided, and connected to the reset logic 68 and motor control 70 for manually resetting the pins if desired.

The cam control 62 is provided with a lobe 82 for operating the contacts 60, 76 and 78 as it performs each revolution.

STATEMENT OF OPERATION

Two sequences of operations will take place, as has been noted above. The first operation is the removal of a single pin or in any event less than five pins, and the resetting of the remaining pins.

The final sequence of operation takes place when the last pin is down. At this time, the last pin or pins are then removed upwardly and all five pins are then reset ready for the next bowler's turn.

The first sequence of operation takes place as follows.

It will be assumed for the purposes of this explanation that the five pins are standing in their ready position in the bowling lane, with the five pin ropes loosely arranged within the tensioning mechanism T, and the tensioning bar 12 will be in its forward position. At this point, the cam control 62 is in its at rest position, with the lobe 82 closing the contacts 60 as shown in FIG. 4. In this position, the power supply to the motor control 70 is on. However, the motor control 70 is rendered inactive by the control exercised over it by the timer 66. In addition, power is supplied to the reed switches 44*a*, *b*, and *c*, and also to coils 54 and 56 *a*, *b*, and *c*.

Contacts 76 are open, thereby preventing any power supply to the brake solenoid switches 72*a*, *b* and *c*, and contacts 78 are closed thereby supplying power to the timer 66 and reset logic 68.

At this time, and prior to the falling of any of the pins, the pulleys 20 themselves may be in any random rotational position with respect to the reed switches 44 and 46 fastened to the plates 48. The magnetic field of the magnet 52 is such that it is capable of closing either reed switch 44 or 46 over a relatively wide arc either side of each reed switch. In fact, the magnet 52 is ineffective with regard to the reed switches only when the reed switches are located more or less along a line perpendicular to the magnet 52. Since the pulley 20 will have stopped at a random position, in all likelihood the magnet 52 is sufficiently close to one or other of the reed switches 44 or 46 to cause them to close while the pulley 20 is stationary. Thus, in the start up position, either switch 44*a*, *b*, *c* etc or switch 46*a*, *b c* etc. will already have been closed. Thus, it will only take a partial rotation of the pulley 20 of any particular rope, to close the other reed switch.

In the relatively unusual case where the reed switches 44 and 46 are located perpendicular to the magnet 52, then neither of the reed switches will have been closed, and it will take approximately two-thirds of a rotation to close both reed switches.

The bowler then bowls his first ball and it is assumed that he knocks down one pin. The pin rope will then draw the pulley 20 associated with it around, and cause the magnet 52 to pass over the reed switches 44 and 46. As described above, one of the reed switches 44 or 46 will already have been closed in all probability, so that it will only require less than one half of a rotation to close the other reed switch. The closure of the two reed switches will then complete the circuit to their associated relay 64*a*, *b*, or *c*. The relay 64 will then close, closing the brake solenoid switch 72 and the relay hold switch 74. The brake solenoid 38 will however remain inactive since the solenoid contact 76 is still open at this point and therefore there is no power supply to the switch 72.

Simultaneously, the relay 64 will deliver a signal to the timer 66 and the reset logic 68. The signal to the timer 66 initiates a predetermined delay after which the timer 66 signals the motor control 70 to start up the motor M. As the motor M rotates, it will drive the cam control 72 around in a clockwise direction. Movement of the cam control 72 will cause the lobe 82 to drop away from the contact 60 thereby opening the contact 60 and cutting off power to the reed switches 44 and 46, and their associated coils 54 and 56.

The reed switches 44 and 46 will then open, since the coils 54 and 56 are deativated, and will then remain open as long as the pulley 20 rotates. Since the magnet 52 alone is not strong enough to close the switches 44 and 46 without the assistance of the coils 54 and 56.

However, since the particular relay 64 that has initiated the signal has already closed its own holding switch 74, such relay 64 will remain closed not withstanding the breaking of the circuit by the opening of the reed switches 44 and 46.

The signal from the relay 64 to the reset logic 68 is recorded in a suitable memory bank circuit in the reset logic, there being sufficient such memory banks for all the bowling pins whether five or more.

As the cam control 62 continues to rotate the lobe 82 will close the contact 76 and thereby activating the appropriate brake solenoid, through the switch 72 thereof which has been closed by its associated relay 64. The remaining brake solenoids 38 will of course remain inactivated since their switches 72 remain open.

As the cam 62 rotates further the contact 76 is opened once more thereby deactivating the brake solenoid 38. However, the brake solenoid 38 will only require momentary operation, since once the brake shoe 32 has swung firmly into engagement with the rope R, the continued pull of the pin P merely causes the brake shoe 32 to jam more tightly against the rope R not withstanding deactivation of the brake solenoid 38.

As the cam 62 continues to rotate the lobe 82 will cause the contacts 78 to open thereby breaking the circuit to the timer 66 and the reset logic 68. This causes the timer 66 to be reset to 0, and in the reset logic 68, it will have no effect during this cycle. The cam 62 then completes its rotation with the lobe 82 closing the contacts 60 once more. The closing of the contacts 60 signals the motor control 70 to stop, and the motor M then stops and the cam 62 comes to rest with the lobe 82 maintaining the contact 60 closed.

Closing of the contact 60 will then again supply power to the reed switches 44*a*, *b*, and *c* and their coils 54*a*, *b*, and *c* and also the coils 56*a*, *b*, and *c*.

This cycle of operation will be repeated each time a further pin is knocked down, until the last pin is knocked down.

Each time the cycle is repeated the brake solenoids 38 for the pin or pins that have already been retracted are momentarily energized so as to retain the pins in their upper position.

The final cycle of operation will then take place. As the last pin is knocked down its associated pulley 20 will rotate thereby closing the remaining reed switch 44 or 46, and closing its associated relay 64. Closure of the last relay 64, by falling of the last pin associated therewith, will again signal the timer 66 to start up the motor control after a predetermined delay which then starts the motor. At the same time, however, the relay also signals the reset logic 68 that the last pin has fallen. When the reset logic 68 has received signals indicating that all five or more pins have fallen, then it immediately cuts off power to the switches 74*a*, *b* and *c* and thereby causes the closed relays 64 to reopen. In this way, closing of any of the brake solenoids 38 is prevented, and as the rope tension unit T tensions all of the ropes, the weight of the pins, which has hitherto maintained the individual brake shoes in their closed positon, is taken by the rope rensioning unit T itself. Since there is no longer any weight on the brake shoes, they are released and will swing into their downward position.

As the cam continues to rotate, and as the rope tensioning unit continues to move, it will then relax the ropes, and permit the pins to descend gradually to the pin deck of the bowling lane in their predetermined position. As the pins descend, they will of course rotate the pulleys 20, and when they come to rest on such floor, the pulleys 20 will come to rest in a randomly oriented position as described above.

When the lobe 82 of the cam control 62 reaches the switch 78, it triggers the timer and the reset logic 68 to reset, and clear, respectively ready for the next bowler's turn.

In the conventional game, a bowler's turn is completed after three balls. If any pins remain standing, then the final resetting cycle is activated by the manual reset button 80 which is connected to the reset logic and triggers the initiation of the final reset cycle as described above.

In this way, it will be noted that the pulleys 20 are at all times completely free of any restraint whatever, and may rotate so as to permit the ropes to run as freely as possible at all times and minimize wear and friction.

Many variations could be made within the scope of the invention.

For example, if greater sensitivity is required two magnets could be placed on a pulley separated by an arc of approximately 90°. In this way, the sensitivity of the device would be greatly increased so as to insure commencement of a resetting cycle at an earlier point.

Similarly, more than two reed switches could be incorporated in the device for the same purpose.

The invention is equally applicable to bowling alleys having either less or more than five bowling pins, using essentially the same circuit.

Figure 6:
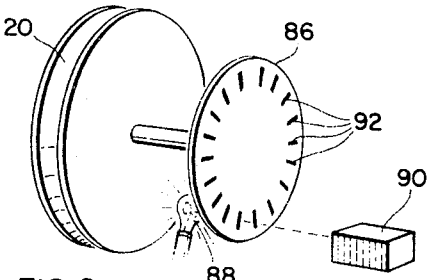
FIG. 6 illustrates another alternate form of sensing.

As mentioned, the remote sensing of the movement of the pulley, by means of the reed switches and the magnet, is merely one of several different means of remote sensing which would be equally acceptable. Thus, for example the pulley could be associated with some form of photo-sensitive means, either by a light beam passing through an opening in the pulley for example, or through a light beam being reflected off a portion of the pulley by a mirror mounted on the pulley. Alternatively, remote sensing may be effected by means of the pulley 20 being associated with a separate disc 86 running between a light source 88 and a photo diode 90, the disc 86 having suitable openings or transparent portions alternating with opaque portions 92, as shown in FIG. 6. Similarly, proximity switches could be used, and a variety of other such remote sensing systems will suggest themselves to persons skilled in the art.

Figure 5:
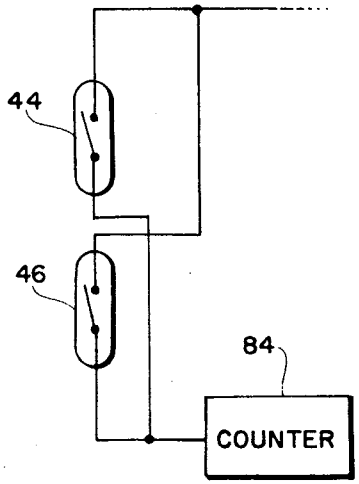
FIG. 5 is a partial diagramme of an alternate form.

According to a still further embodiment of the invention, as shown in FIG. 5, the holding coils 54 and 56 may be dispensed with, and the two reed switches 44 and 46 may be separately connected to any suitable counter means 84. The counter means is in turn connected with the timer. The other details of the circuit are the same as that shown in FIG. 4.

In this form of the invention, the counter means is programmed to deliver a signal to the timer as soon as it receives a signal from each reed switch connected to it.

The foregoing description of a preferred embodiment of the invention is given here by way of example only. The invention is not to be taken as limited to any of the specific features as described, but comprehends all such variations as come within the scope of the appended claims.

The embodiments of the invention in which an exclusive property or privilege is claimed are defined as follows:

1. A pin rope control for use in motorized pin setting apparatus wherein said pins are attached to ropes, said control comprising;

supporting means;

a pulley wheel mounted thereon around which a said rope runs in both forward and reverse directions, said pulley wheel being freely rotatable in either direction in response to any movement of said rope either in the forward or reverse direction and being free of any interruption by any other means thereby permitting the pulley wheel to stop at any random position in response solely to said rope and permitting said pulley to start rotation freely without restraint in response to movement of said rope, and, remote sensing means free of any mechanical connection with said pulley and responsive only to movement of said pulley wheel from any random at rest position to generate at least one signal, said signal being operative to trigger operation of said motorized pin setting apparatus and said remote sensing means being inoperative to trigger such operation while said pulley wheel is at rest.

2. A pin rope control as claimed in claim 1, including sequence control means connected to be responsive to a signal from said remote sensing means to initiate operation of said motorized pin setting apparatus in predetermined sequence.

3. A pin rope control as claimed in claim 2, including brake means for engaging said rope, and electrical means for controlling said brake means, said electrical means being responsive to said sequence control whereby to procure operation of said brake means at a predetermined point in the operation of said motorized pin setting apparatus.

4. A pin rope control as claimed in claim 1, including relay means connected to said remote sensing means, and responsive thereto to deliver a continuous signal so long as any of the pins of said pin setting apparatus remain in position, and being deactivated when all said pins have been displaced.

5. A pin rope control as claimed in claim 4 including logic means connected to said relay means for receiving said continuous signal therefrom, and said logic means delivering a signal in response to receipt of said signals from all said relay means, to deactivate said relay means.

6. A pin rope control as claimed in claim 5 including manual reset means connected to said logic means for manually triggering the same to deliver said signal for deactivating said relay means.

7. A pin rope control as claimed in claim 1 wherein said remote sensing means comprises magnet means mounted for rotation in unison with said pulley, and magnetically sensitive means mounted in fixed relation to said pulley adjacent to the circular path of movement of said magnet means, when the same is moving in unison with said pulley as aforesaid.

8. A pin rope control as claimed in claim 7 wherein said magnetically sensitive means comprise at least one reed switch, and including holding coil means associated with said reed switch.

9. A pin rope control as claimed in claim 7 wherein said magnetically sensitive means comprises at least two reed switches operated successively by impulses from said magnet means, and including circuit means connected with said reed switches and operating in response to operation of a said reed switch subsequent to the first such switch operated by said magnet means to procure operation of said pin setting apparatus.

10. A pin rope control as claimed in claim 1 wherein said remote sensing means comprises photo sensitive signal generating means, a light source therefor, establishing a light path to said photo sensitive means, the same being mounted in fixed relation relative to said pulley as aforesaid, and including light interrupter means rotatably mounted in association with said pulley for rotation in unison therewith, and passing through said light path, whereby to interrupt passage of light to said photo sensitive means upon rotation of said pulley.

11. A pin rope control for use in motorized pin setting apparatus wherein pins are attached to ropes, said control comprising;

a pulley freely mounted for rotation without mechanical interruption, said rope running over said pulley, said pulley being free to come to rest at any rotational position thereby insuring free running of said pulley;

mounting means for supporting said pulley in a desired location;

magnet means mounted for rotation in unison with said pulley, and at least two magnetically sensitive means mounted in fixed relation to said pulley adjacent to the circular path of movement of said magnet means, proximity of said magnet means to said magnetically sensitive means operating the same and initiating signals, and, circuit means connected to said magnetically sensitive means for receiving signals therefrom and operable to trigger said motorized pin setting apparatus after said pulley has moved from a random at rest position in response to a signal from a said magnetically sensitive means subsequent to the first such magnetically sensitive means, and before it has completed one revolution.

12. A pin rope control for use in motorized pin setting apparatus wherein pins are attached to ropes, said control comprising;

a pulley freely mounted for rotation without mechanical interruption, said rope running over said pulley, said pulley being free to come to rest at any rotational position thereby insuring free running of said pulley;

mounting means for supporting said pulley in a desired location;

photo sensitive signal generating means, a light source therefor, establishing a light path to said photo sensitive means, the same being mounted in fixed relation relative to said pulley as aforesaid, and including light interrupter means rotatably mounted in association with said pulley for rotation in unison therewith, and passing through said light path, whereby to interrupt passage of light to said photo sensitive means upon rotation of said pulley, thereby generating signals responsive to such rotation, and, circuit means connected to said signal generating means for receiving signals therefrom and operable to trigger said motorized pin setting apparatus after said pulley has moved from a random at rest position, and before it has completed one revolution.

13. A pin rope control for use in motorized pin setting apparatus wherein said pins are attached to ropes said control comprising;

supporting frame means;

a pulley wheel freely mounted thereon for rotation without mechanical interruption, said rope running over said pulley, said pulley being free to come to rest at or start from any random rotational position;

remote sensing means supported on said frame means in fixed relation adjacent said pulley for sensing the rotational position of said pulley without mechanical contact therewith, and independently of the at rest position of said pulley;

remote actuating means on said pulley for actuating said remote sensing means and operable to deliver at least two impulses thereto in sequence responsive to at least two rotational positions of the pulley, and, circuit means connected to said remote sensing means and responsive to an impulse subsequent to the first such impulse to trigger said motorized pin setting apparatus after said pulley has moved from a random at rest position, and before it has completed one revolution, and being inoperative in response to the first such impulse.

* * * * *